US011435141B2

(12) United States Patent
Wood

(10) Patent No.: US 11,435,141 B2
(45) Date of Patent: Sep. 6, 2022

(54) RADIANT CONVEYOR DRYING SYSTEM AND METHOD

(71) Applicant: William J. Wood, Whitewater, WI (US)

(72) Inventor: William J. Wood, Whitewater, WI (US)

( * ) Notice: Subject to any disclaimer, the term of this patent is extended or adjusted under 35 U.S.C. 154(b) by 113 days.

(21) Appl. No.: 17/035,102

(22) Filed: Sep. 28, 2020

(65) Prior Publication Data

US 2021/0123675 A1 Apr. 29, 2021

Related U.S. Application Data

(60) Provisional application No. 62/926,002, filed on Oct. 25, 2019.

(51) Int. Cl.
*F26B 23/02* (2006.01)
*F26B 3/06* (2006.01)
(Continued)

(52) U.S. Cl.
CPC ..... *F26B 23/02* (2013.01); *F26B 3/06* (2013.01); *F26B 3/283* (2013.01); *F26B 17/08* (2013.01); *F26B 25/16* (2013.01)

(58) Field of Classification Search
CPC ..... F26B 23/02; F26B 23/06; F26B 3/283; F26B 17/08; F26B 25/16
(Continued)

(56) References Cited

U.S. PATENT DOCUMENTS 2,684,668 A * 7/1954 Culp ..... F26B 21/001 126/110 B
3,512,765 A * 5/1970 Van Der Lely ..... F26B 1/005 432/154
(Continued)

FOREIGN PATENT DOCUMENTS

CA 993259 7/1976
CA 2082311 11/1992
(Continued)

*Primary Examiner* — Stephen M Gravini
(74) *Attorney, Agent, or Firm* — Ryan Kromholz & Manion, S.C.

(57) ABSTRACT

A system according to the present invention provides a radiant conveyor drying system and method of operation. The radiant conveyor drying system generally comprises an input assembly, a drying assembly and an exit assembly mechanically fixed to one another. The drying assembly comprising at least one drying unit in communication with one another to provide for passage of product between the respective drying units and the input assembly and the exit assembly. The drying unit comprising a conveyor belt and a drying unit heating assembly. The drying unit heating assembly comprising a plenum and a heating chamber. The drying unit further comprising a burning unit in communication with the heating chamber to provide for radiant heat to contact the product traveling on the conveyor through the drying unit. The drying unit further comprising a blower fan in communication with the plenum to provide for convective air advancing from the plenum, over and through the radiant heat, to the product. Wherein the radiant heat is disbursed throughout the product. A first embodiment of the invention controlling hear generated by the burning unit of each respective drying unit. A second embodiment of the invention controlling heat generated by the burning unit and rate of the conveyor of each respective drying unit. A method of operation of the radiant conveyor drying system is described.

19 Claims, 9 Drawing Sheets

(51) Int. Cl.
*F26B 25/16* (2006.01)
*F26B 17/08* (2006.01)
*F26B 3/28* (2006.01)

(58) Field of Classification Search
USPC ..... 34/205
See application file for complete search history.

(56) References Cited

U.S. PATENT DOCUMENTS 3,711,959 A * 1/1973 van der Lely ..... F26B 17/02 34/189
4,038,760 A * 8/1977 Monck ..... F26B 11/185 432/103
4,346,523 A * 8/1982 Ronning ..... F26B 11/0413 432/106
5,233,763 A 8/1993 Minnie, Jr.
5,517,767 A * 5/1996 Schechinger ..... F26B 17/1491 34/174
5,557,858 A 9/1996 Macaluso et al.
5,557,859 A * 9/1996 Baron ..... F26B 21/083 34/512
5,651,193 A * 7/1997 Rhodes ..... F26B 25/009 34/535
5,678,494 A * 10/1997 Ulrich ..... F23G 5/04 110/212
5,960,560 A * 10/1999 Stoll ..... F26B 3/286 34/529
6,088,929 A * 7/2000 Watson ..... F26B 17/122 34/169
6,539,645 B2 4/2003 Savarese
7,024,796 B2 * 4/2006 Carin ..... F26B 23/001 34/514
8,117,764 B2 * 2/2012 Ness ..... C10L 9/08 34/497
8,984,763 B2 * 3/2015 Savarese ..... F26B 13/10 34/446
9,015,955 B2 * 4/2015 Vezina ..... D06F 59/02 248/163.1
9,301,535 B1 * 4/2016 Bearg ..... F26B 19/005
9,687,021 B2 * 6/2017 Mocelin ..... F26B 25/12
9,851,109 B2 12/2017 Bilet et al.
10,035,592 B1 7/2018 Chen et al.
10,281,211 B2 5/2019 Savarese
10,415,882 B2 * 9/2019 O'Gary ..... F26B 25/10
10,724,794 B2 * 7/2020 Niklaus ..... F26B 13/06
10,850,917 B2 * 12/2020 Ramandev ..... F26B 21/08
2010/0088920 A1 4/2010 LaRou
2021/0123675 A1 * 4/2021 Wood ..... F26B 3/305

FOREIGN PATENT DOCUMENTS

CA 2886040 8/2018
CN 201709311 1/2011
CN 205511996 8/2016
CN 108397993 8/2018
GB 2590166 A * 6/2021 ..... F26B 17/04
JP S58208576 12/1983
JP 2002048470 2/2002

* cited by examiner

RADIANT CONVEYOR DRYING SYSTEM AND METHOD

RELATED APPLICATIONS

This application claims the benefit of provisional application Ser. No. 62/926,002 filed on Oct. 25, 2019.

BACKGROUND OF THE INVENTION

The present invention is directed generally to drying systems, and more specifically to drying systems for removing moisture from plant products, cultivated and uncultivated. More specifically, the present invention is to a radiant conveyor drying system and method of operation of the radiant conveyor drying system.

The farming industry remains attentive to how much moisture is in a respective bushel or bundle of product. Additionally, providers of soil and uncultivated product parts, such as mulch, are continuously concerned with the amount of moisture within the product. Too little moisture results in a vulnerable plants prior to harvesting, and damage to product during storage due to brittleness. Too much moisture may resulting in molding of product during storage. In practice, harvesters of product seek to harvest the product when the product contains a percentage of moisture above or at least substantially close to the upper level of moisture ideal for storage. Upon harvesting, the product is dried so that the produce has a percentage of moisture ideal for at least one of storage and the next step of production.

Prior art operations of drying of product include a surface for laying product cut to be dried by solar energy. Mechanized prior art operations include systems in which the product is positioned into housing units providing for stationary heating of the product. However, stationary heating does not provide for a continuous operation. Additional prior art systems provide for a movement of product through the system. However, certain prior art systems apply an auger type mechanism to advance product. The auger type systems does not provide for a controlled environment to ensure accurate drying of product. Additional prior art incorporates a conveyor type advancing element. However, these prior art operations position radiant heating elements either under the product of beside the product as the product moves along the conveyor. Further, where a convection element is incorporated, the output of air from the convection elements are besides or nearly planar to the radiant heating elements. The prior art orientation of the convection output and heating elements does not provide for an efficient distribution of the radiant heat produced.

It is observed certain prior art operations do provide for a layered orientation of the drying layers. However, none of these prior art product drying operations provides for a means to remove byproduct of the harvesting process amalgamated with the product.

A need exists for a radiant conveyor drying system comprising a conveyor system.

A need exists for a radiant conveyor drying system comprising a layered conveyor system.

A need exists for a radiant conveyor drying system comprising at least one radiant element above the product.

A need exists for a radiant conveyor drying system comprising a convection directing air through the at least one radiant element and towards the product.

A need exists for a radiant conveyor drying system comprising an element for continuous removal of byproduct.

SUMMARY OF THE INVENTION

The present invention is directed generally to drying systems, and more specifically to drying systems for removing moisture from plant products, cultivated and uncultivated. More specifically, the present invention is to a radiant conveyor drying system and method of operation of the radiant conveyor drying system.

A radiant conveyor drying system and support structure combination is provided. The radiant conveyor drying system and support structure combination comprises a radiant conveyor drying system and a support structure. The radiant conveyor drying system has an input assembly, drying assembly and exit assembly mechanically fixed to one another. The input assembly is in close proximity to a drying assembly first end and the exit assembly is at least in close proximity to a drying assembly second end.

The input assembly comprises a hopper. A cut off plate covers a hopper second end opening. The volume of product exiting the hopper into the drying assembly is controlled by manual adjustment of the cut off plate.

The cut off plate is in close proximity to a first conveyor. A first conveyor belt provides for advancement of the product towards a radiant conveyor drying system first side. A transfer chute is mechanically fixed to the first conveyor such that product advances from the first conveyor belt and into the drying assembly. It is understood product incorporates any and all cultivated products (such as corn, grains, etc.) and uncultivated products (such as mulch, branches, leaves and grasses).

The drying assembly comprises at least one drying unit. Preferably the drying assembly comprises four drying units, where the drying units are layered one on top of the other. Each of the at least one drying units comprises a drying unit heating assembly in communication with a drying unit conveyor. Each drying unit heating assembly comprises a drying unit power assembly in communication with a drying unit chamber. The drying unit power assembly comprises a blower fan and burning unit. The drying unit chamber is defined by a drying unit chamber barrier. The drying unit chamber comprises a plenum and a heating chamber. The blower fan is fixed to the drying unit chamber, such that the blower fan advances air into the plenum. The burning unit is fixed to the heating chamber.

The drying unit conveyor extends along a radiant conveyor length, such that the heating chamber, and the plenum and the drying unit chamber extends along the radiant conveyor length. The product is transferred from the transfer chute between the first conveyor and a drying unit conveyor at the radiant conveyor first side. The drying unit conveyor advances the product in the direction of a radiant conveyor second side, wherein the product is transferred from a first drying unit to a second drying unit. It is understood that in subsequent drying units, the drying unit conveyor advances the product from either the radiant conveyor first side to the radiant conveyor second side, or the radiant conveyor second side to the radiant conveyor first side.

An entry transfer chute is positioned along at least one of the radiant conveyor drying system first side and the radiant conveyor drying system second side of each drying unit. The product traverses through the entry chute and exits the entry chute second end onto the drying unit conveyor of the respective first drying unit or second drying unit. The product travels along the drying unit conveyor to the opposite end of the drying unit. An entry chute of the subsequent drying unit provides for transfer of the product to the second drying unit. There may be multiple first drying units and second drying units in a radiant conveyor drying system. Further, a respective drying unit may be represented as a first drying unit and a second drying unit.

A drying unit chamber barrier preferably comprises a triangular cross-section. An apex of a second drying unit is positioned below the drying unit conveyor of the drying unit. Where by-product falls through the drying unit conveyor, more specifically the drying unit conveyor belt, the by-product is directed away from the radiant conveyor drying system via the triangular cross-sectioned drying unit chamber barrier. Regarding communication between the drying unit chamber barrier and the drying unit conveyor belt, at least one side bolster extends from the drying unit chamber barrier into the plenum in close proximity to at least one of a conveyor first side and a conveyor second side. A wear bar is in adjustable communication with the bolster. The wear bar has an adjustment mechanism in order to position the wear bar in close proximity to the drying unit conveyor belt.

The burning unit is connected to at least one heating element. The heating element extends into the heat chamber. The heat produced in the burning unit radiates into the heating chamber. A plenum floor separates the plenum and the heating chamber of each drying unit.

The blower fan and a heat exchanger, within the drying unit chamber, are in close communication to one another. Air from the blower fan is blown through the heat exchanger and into the plenum. Radiant heat is transferred into the heat exchanger through the heating element. The heated convective air enters the plenum. A plenum floor comprises at least one floor through hole. The air transferred into the plenum through convection exits the plenum through the at least one floor through hole.

Two embodiments of the drying unit conveyor belt may be provided, a perforated conveyor belt and a chain mesh conveyor belt, allowing for by-product to fall through the conveyor belt. A conveyor belt tensioner is provided for adjusting the tension of the drying unit conveyor belt.

The drying unit chamber barrier comprises a barrier frame and a barrier shell, comprised of at least one barrier sheet. Alternatively, the drying unit chamber barrier may comprise at least one barrier sheet without the barrier frame.

The exit assembly is attached to one of the drying units of the radiant conveyor drying system to provide for removal of product from the radiant conveyor drying system following progression through the radiant conveyor drying system.

At least one of a first embodiment of the radiant conveyor drying system and a second embodiment of the radiant conveyor drying system incorporates at least one aspect of the radiant conveyor drying system as previously described.

The first embodiment of the radiant conveyor drying system and the second embodiment of the radiant conveyor drying system comprises a programmable logic controller (PLC). The PLC is in electric communication with at least one of the first conveyor motor and each of the conveyor motors providing movement to each of the respective conveyors. The PLC is in electrical communication with the blower fan and burning unit of each drying unit.

The first embodiment of the radiant conveyor drying system and the second embodiment of the radiant conveyor drying system comprise at least one moisture sensor in electrical communication with the PLC. The moisture sensor may incorporate a first temperature sensor. The moisture sensors and the first temperature sensors transmit readings to the PLC at a predetermined time interval. The first embodiment of the radiant conveyor drying system and the second embodiment of the radiant conveyor drying system further incorporate at least one second temperature sensor electrically coupled to the PLC. The second temperature sensor transmits temperature readings of the convective air, heated convective air, within the plenum to the PLC at a predetermined time interval. Alternatively, the second temperature sensor may transmit temperature readings of a product surface temperature of the product on the respective drying unit conveyor to the PLC at a predetermined time interval. Alternatively, the second temperature sensor may transfer both temperature readings of the convective air, heated convective air, within the heating chamber and temperature readings of the product surface temperature of the product to the PLC at a predetermined time interval. The first embodiment of the radiant conveyor drying system and the second embodiment of the radiant conveyor drying system comprise at least one moisture sensor, as previously described, positioned in the exit assembly of the radiant conveyor drying system.

The first embodiment of the radiant conveyor drying system adjusts heat produced by each burning unit through calculations of the data received from the moisture sensor, the second temperature sensor, and where applicable the first temperature sensor. The calculations and adjustments continue at a predetermined rate in order to attain an optimum moisture reading from the moisture sensor at or in close proximity to the exit assembly for the product. It is observed the blower fans, conveyor motors and first conveyor motor are preferably maintained at a constant speed.

The second embodiment of the radiant conveyor drying system adjusts heat produced by each burning unit and an independent preferred speed of each conveyor motor and the first conveyor motor through calculations of the data received from the moisture sensor, the second temperature sensor, and where applicable the first temperature sensor. The calculations and adjustments continue at a predetermined rate in order to attain an optimum moisture reading from the moisture sensor at or in close proximity to the exit assembly for the product. It is observed the blower fans, conveyor motors and first conveyor motor are preferably maintained at a constant speed.

A preferred embodiment may be described as, a radiant conveyor drying system for plant products, comprising: a drying assembly, having a length; the drying assembly having at least two drying units in layered communication substantially parallel to the length; the drying unit with a chamber and a conveyer in communication along the length; the drying unit providing for at least one of a radiant beat and a convective air within the chamber; and the chamber defined by a barrier having at least a substantially triangular cross-section with an apex, opposite said conveyor, and sides extending from the apex.

The invention further comprising: the drying assembly having four drying units in layered communication substantially parallel to the length; the chamber having a plenum positioned over a heating chamber, with the heating chamber positioned over the conveyor; the heating chamber is in communication with a burning unit, wherein in the radiant heat is provided through the heating chamber; the plenum is in communication with a fan, wherein said connective air is promoted into said plenum; the plenum having a floor with at least one through hole for promotion of the convective air into the heating chamber; the conveyor of a first drying unit is positioned over, and in close proximity to, the apex of a second drying unit; the sides of a second drying unit are surfaces for a by-product removal from the first drying unit;

at least one chute for a plant product transfer from said first drying unit to said second drying unit; at least one side having an adjustment bar, opposite said apex, to provide for a close proximity between said side and said conveyor; the barrier is defined by at least one of a shell and a frame; the shell is comprising more than one sheet; an input for addition of said plant product to the system; the input having a cut off plate for manual control of a flow of the plant product into the system; at least one of at least one moisture sensor and at least one temperature sensor to acquire measurement data, the measurement data comprising at lease one of temperature of the plant product, humidity of the plant product, and temperature of the convective air in at least one drying unit; and the system provides an adjustment to at least one of a temperature within at least one the chamber and a rate of travel of at least one the conveyor based upon the measurement data.

A method for operating the radiant conveyor drying system is described. It is understood that the radiant heat initially contacts a top product layer. The radiant heat evaporates moisture on the surface of the individual parts of the top product layer. The heated convective air advances the radiant heat towards the remaining product. The radiant heat evaporates the moisture on the surface of the individual parts of the remaining product. This process of radiant evaporation and convection continues through the radiant conveyor drying system.

The method may preferably comprise: positioning a plant product onto a conveyor of a first drying unit, wherein the drying unit comprises a plenum; advancing the conveyor; producing radiant heat in said drying unit with at least one of a burning unit and a heating element; directing the radiant heat in an downward direction onto the plant product positioned in the conveyor; producing convective air in the drying unit with at least one of a fan and a heat exchange; promoting movement of the convective air in a downward direction about the plant product positioned in the conveyor; and encouraging movement of radiant heat through the plant product with said convective air.

The method may further comprise: transferring product to a subsequent drying unit; in the subsequent drying unit, repeating the steps of: positioning of the plant product, advancing of the conveyor, producing radiant heat, directing radiant heat, producing convective air, promotion of movement of convective air, and encouraging movement of radiant heat through the plant product with the convective air; and promoting movement of said convective air in a downward direction through at least one hole in a floor of said plenum, and about said plant product.

The invention provides for an intended benefit of a radiant conveyor drying system comprising a conveyor system.

The invention provides for an intended benefit of a radiant conveyor drying system comprising a layered conveyor system.

The invention provides for an intended benefit of a radiant conveyor drying system comprising at least one radiant element above the product.

The invention provides for an intended benefit of a radiant conveyor drying system comprising a convection directing air through the at least one radiant element and towards the product.

The invention provides for an intended benefit of a radiant conveyor drying system comprising an element for continuous removal of byproduct.

DESCRIPTION OF THE PREFERRED EMBODIMENT

Although the disclosure hereof is detailed and exact to enable these skilled in the art to practice the invention, the physical embodiments herein disclosed merely exemplify the invention which may be embodied in other specific structures. While the preferred embodiment has been described, the details may be changed without departing from the invention, which is defined by the disclosure.

Figure 1:
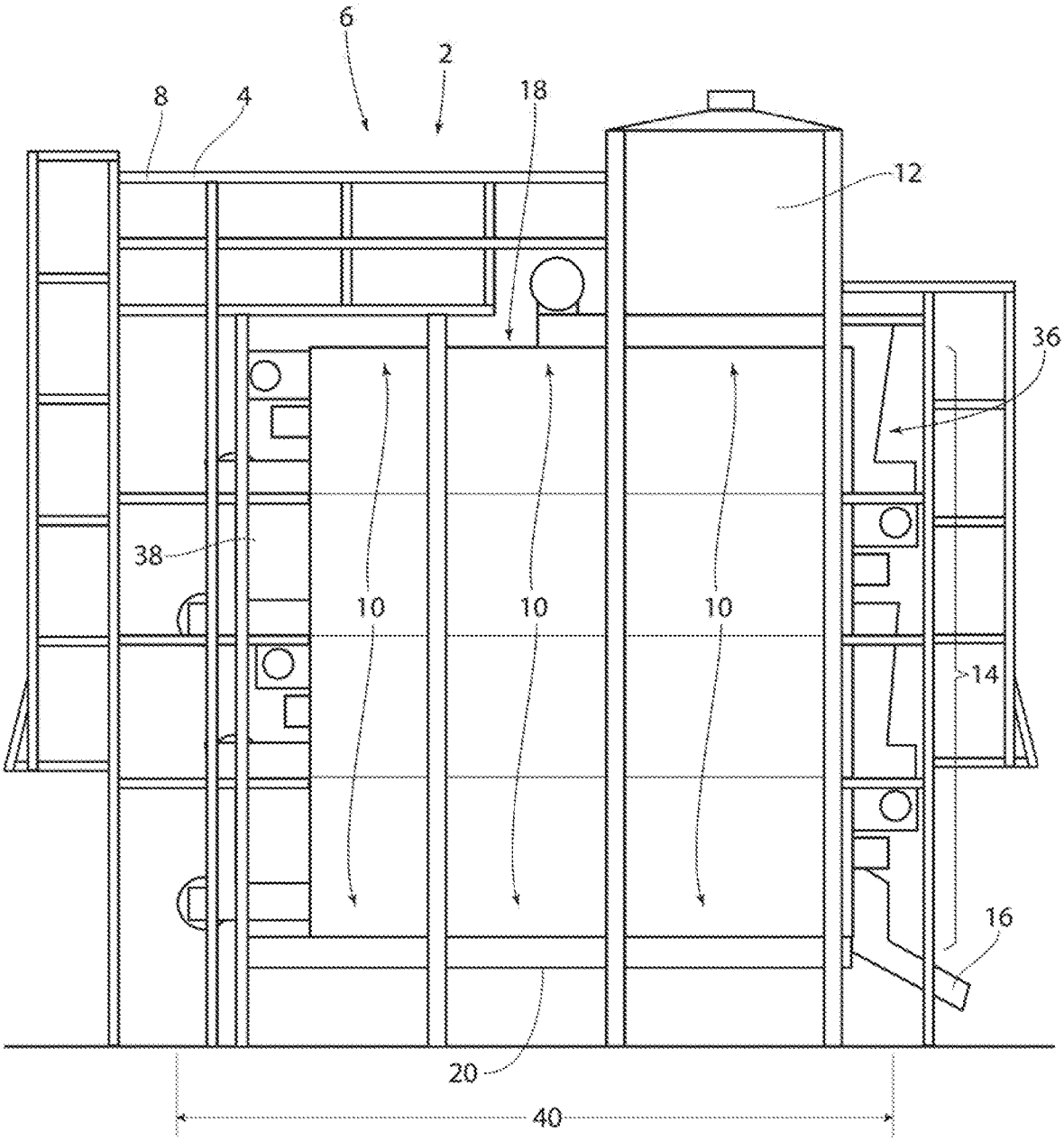
FIG. 1 is a side view of a radiant conveyer drying system and a support structure.

With attention to FIG. 1, a radiant conveyor drying system and support structure combination 2 is illustrated. The radiant conveyor drying system and support structure combination 2 comprises a radiant conveyor drying system 6 and a support structure 4. The support structure 4 provides a lattice framework 8 at least substantially encasing the radiant conveyor drying system 6. The support structure 4 provides structural stability for the radiant conveyor drying system 6. The support structure 4 provides open volumes 10 for material by-product (not illustrated in the figures) to exit the radiant conveyor drying system 6. The radiant conveyor drying system 6 has an input assembly 12, drying assembly 14 and exit assembly 16 mechanically fixed to one another. The input assembly 12 is in close proximity to a drying assembly first end 18 and the exit assembly 16 is at least in close proximity to a drying assembly second end 20. The drying assembly first end 18 and the drying assembly second end 20 are at least substantially opposed to one another. A radiant conveyor drying system first side 36 extends between the drying assembly first end 18 and the drying assembly second end 20. A radiant conveyor drying system second side 38, oppositely opposed to the radiant conveyor drying system first side 36, extends between the drying assembly first end 18 and the drying assembly second end 20. Wherein the combination of the radiant conveyor drying system second side 38 and the radiant conveyor drying system first side 36 define a radiant conveyor length 40. The exit assembly 16 is preferably a chute. Alternatively, the exit assembly 16 may be at least one of a chute, conveyor or transfer attachment.

Figure 2:
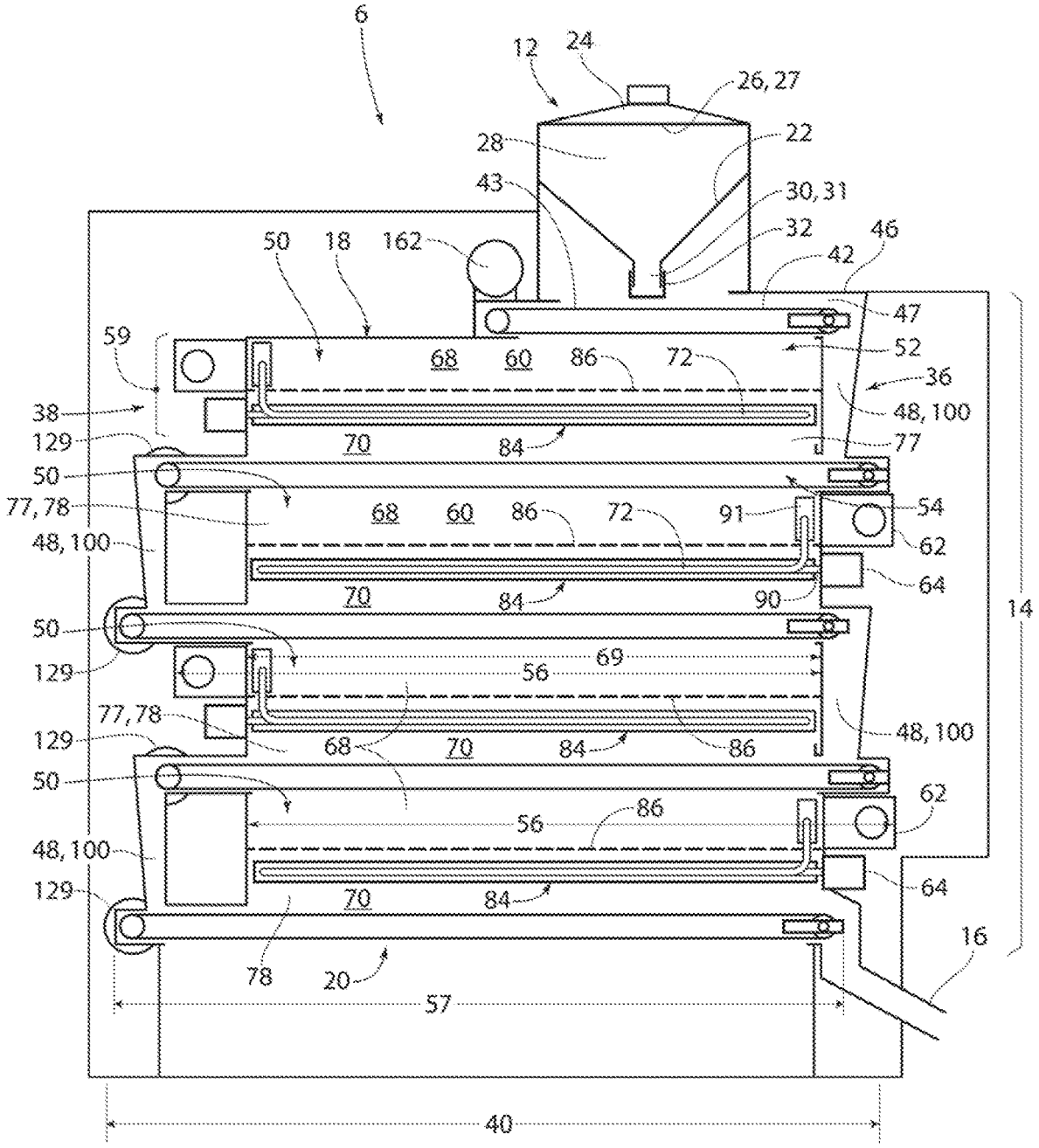
FIG. 2 is a cross-sectional side view of the radiant conveyor drying system.

With attention to FIG. 2, the radiant conveyor drying system is further illustrated. The input assembly 12 comprises a hopper 22. The hopper 22 has a hopper first end 26 for receipt of product 34 (reference FIG. 4B). It is understood product 34 incorporates any and all cultivated products (such as corn, grains, etc.) and uncultivated products (such as mulch, branches, leaves and grasses). A hopper cover 24 is in removable communication with the hopper first end 26 to provide for covering the hopper first end opening 27. A hopper cavity 28 provides for storage of product 34 in the hopper 22. A hopper second end 30, preferably opposite the hopper first end 26, provides for a hopper second end opening 31. A cut off plate 32 covers the hopper second end opening 31. The cut off plate 32 is at least one of in slidable communication and removable communication with the hopper second end opening 31. The volume of product 34 exiting the hoper 22 into the drying assembly 14 is manually controlled by manual adjustment of the cut off plate 32.

Figure 3:
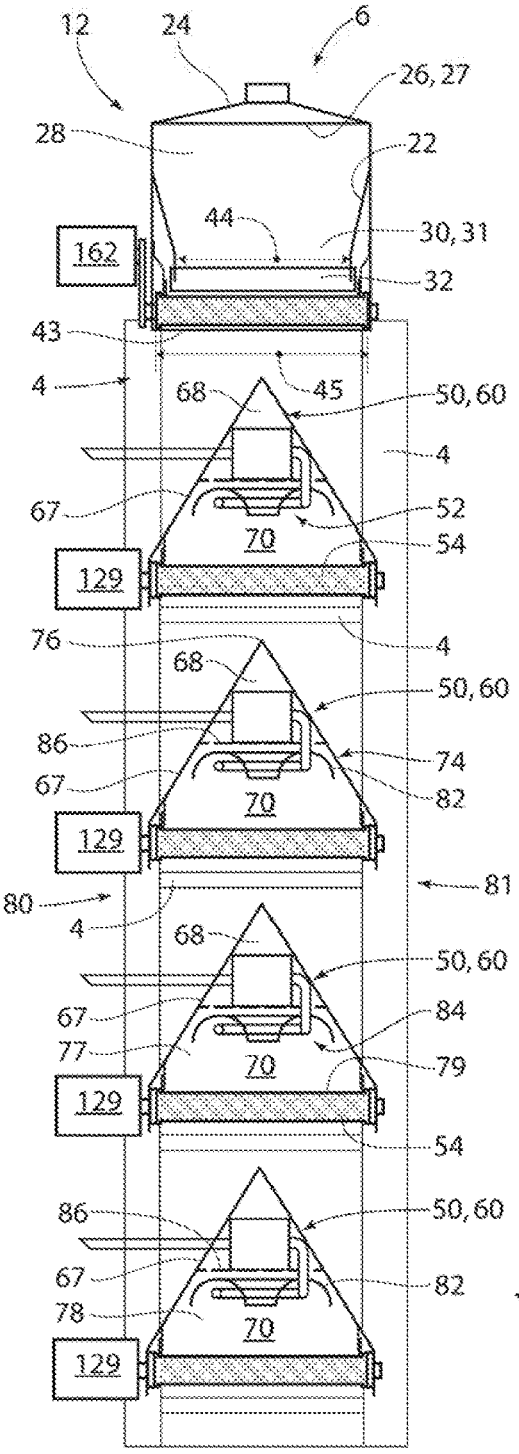
FIG. 3 is a cross-sectional end view of the radiant conveyor drying system.

The cut off plate 32 is in close proximity to a first conveyor 42. The first conveyor having at least a first conveyor belt 43. As illustrated in FIG. 3, the hopper second end opening 31 has a second end opening distance 44 less than the first conveyor belt width 45. The hopper second end opening 31 provides for an amount of product 34 deposited on the first conveyor belt 43 less than or equal to the first conveyor belt width 45 (reference FIG. 3). The first conveyor belt 43 provides for advancement of the product 34 towards the radiant conveyor drying system first side 36. A first conveyor motor 162 provides power to the first conveyor 42 for movement of the first conveyor belt 43. A first conveyor belt enclosure 46 provides a first conveyor cavity 47 in which the first conveyor belt 43 is provided. A transfer chute 48 is mechanically fixed to the first conveyor belt enclosure 46 such that product 34 advances from the first conveyer belt 43 and into the transfer chute 48.

With attention to FIGS. 2 and 3, the drying assembly 14 is further described. The drying assembly 14 comprises at least one drying unit 50. Preferably the drying assembly 14 comprises four drying units 50, where the drying units are layered one on fop of the other along the radiant conveyor length 40, from the drying assembly second end 20 to the drying assembly first end 18. Each of the at least one drying units 50 comprises a drying unit heating assembly 52 in communication with a drying unit conveyor 54. At least one of the drying units 50 provides for at least one of the drying unit heating assembly 52 having a drying unit assembly length 56 at least substantially equal no the radiant conveyor length 40. Alternatively, the drying unit assembly length 56 is less than the radiant conveyor length 40. At least one of the drying units 50 provides for at least one of the drying unit conveyor 54 having a drying unit conveyor length 57 at least substantially equal to the radiant conveyor length 40. Alternatively, the drying unit conveyor length 57 is less than the radiant conveyor length 40.

Each drying unit heating assembly 52 comprises a drying unit power assembly 59 in communication with a drying unit chamber 60 along the radiant conveyor length 40. The drying unit power assembly 59 comprises a blower fan 62 and burning unit 64. The drying unit chamber 60 is defined by a drying unit chamber barrier 67. The drying unit chamber barrier 67 extends a drying unit chamber length 69. A combination of the drying unit power assembly and drying unit chamber 60 extends the drying unit assembly length 56 and the radiant conveyor length 40 for the drying unit chamber length 69. The drying unit chamber 60 comprising a plenum 68 and a heating chamber 70. At least one of the plenum 68 and the heating chamber 70 extends the drying unit chamber length 89. The heating chamber 70 is positioned between the plenum 68 and the drying unit conveyor 54. The blower fan 62 is fixed to the drying unit chamber 60, such that the blower fan advances air into the plenum 68. The burning unit 64 is fixed to the drying unit chamber 60. Specifically, the burning unit 64 is fixed to the heating chamber 70.

The drying unit conveyor 54 extends along the radiant conveyor length 40. The heating chamber 70, and the plenum 68 and the drying unit chamber 60 also extends along the radiant conveyor length 40. A conveyor motor 129 provides power to the drying unit conveyor 54 to advance product resting on the drying unit conveyor 54. An illustrated in FIG. 2, the product 34 is transferred from the transfer chute (48, 100) between the first conveyor 42 and a drying unit conveyor 54 at the radiant conveyor first side 36. The drying unit conveyor 54 advances the product in the direction of the radiant conveyor second side 38. The product 34 is transferred from a first drying unit 77 to a second drying unit 78, the drying unit, conveyor 54 advances the product from either the radiant, conveyor first side 36 to the radiant conveyor second side 38, or the radiant conveyor second side 38 to the radiant conveyor first side 36.

As illustrated in FIG. 3, the drying unit chamber barrier 67 preferably comprises a triangular cross-section 74, a preferably an equilateral triangle cross-section. An apex 76 of the second drying unit 78 is positioned below the drying unit conveyor 54 of the drying unit 50 positioned more closely to the drying assembly first end 18 of the first drying unit 77. Where by-product (not illustrated in the figures) falls through the drying unit conveyor 54, more specifically the drying unit conveyor belt 79, towards at least one of the radiant conveyor first side 80 and radiant conveyor second side 81, the by-product is directed away from the radiant conveyor drying system 6 via the triangular cross-sectioned 74 drying unit chamber barrier 67. As illustrated in FIG. 3, multiple drying units 50, as in the preferred embodiment of four drying units, are positioned such that the by-product (not illustrated in the figures) may be directed away from the radiant conveyor drying system 6.

As illustrated in FIG. 2, the burning unit 64 is connected to at least one heating element 72 at a heating element first end 90. As illustrated in FIGS. 2, 3 and 4A, the heating element 72 extends into the heat chamber 70. The heating element 72 extends at least substantially the drying unit chamber length 69. The heating element 72 preferably extends from at least one of the drying assembly first side 36 and the drying assembly second side 38, extending at least substantially the drying unit chamber length 69, and returns to a location in close proximity to its origin. The heating element 72 is preferably a hollow metal cube. Alternatively the heating element 72 may be comprised of ceramic. The burning unit 64 provides for a heat source. The heat produced in the burning unit 64 radiates through the heating element 72. The heat radiates from the heating element 72 into the heating chamber 70, reference FIGS. 9 and 10. A heat element cover 82 comprising a semi-annular cross-section partially encases the heating element 72 such that the heat element cover 82 provides for a cover open end 84 in the direction of the drying unit conveyor 54. The heat element cover 82 directs the radiant hear 154 (reference FIGS. 9 and 10) produced through the heating element 72 towards the drying unit conveyor 54 and the product 34 traveling along the drying unit conveyor 54.

A plenum floor 86 separates the plenum 68 and the heating chamber 70 of each drying unit 50. In close proximity to the blower fan 62, the heating element provides for a heating element extension 88 into the plenum 68. The heating element extension 88 is affixed at a heating element second end 89 to a heat exchanger 91 positioned in the plenum 68. An exhaust pipe 92 extends from the heat exchanger 91 through the drying unit chamber barrier 67, wherein combustion gases are expelled away from the radiant conveyor drying system 6.

Figure 4B:
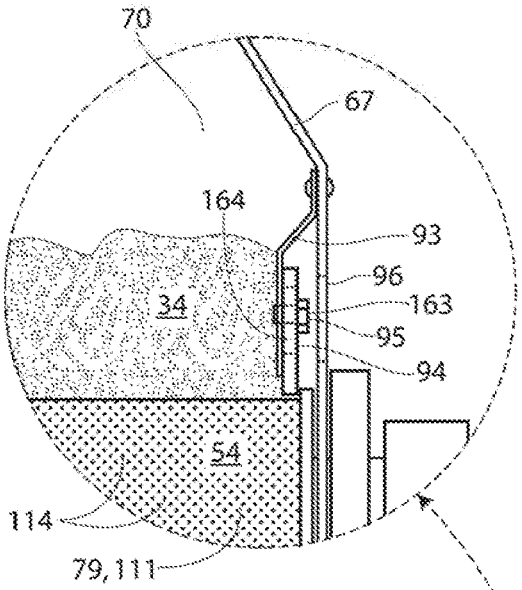
FIG. 4B is an enlarged view of the drying unit, illustrating an interaction between a drying unit chamber barrier and a conveyor belt of the drying unit.
Figure 4A:
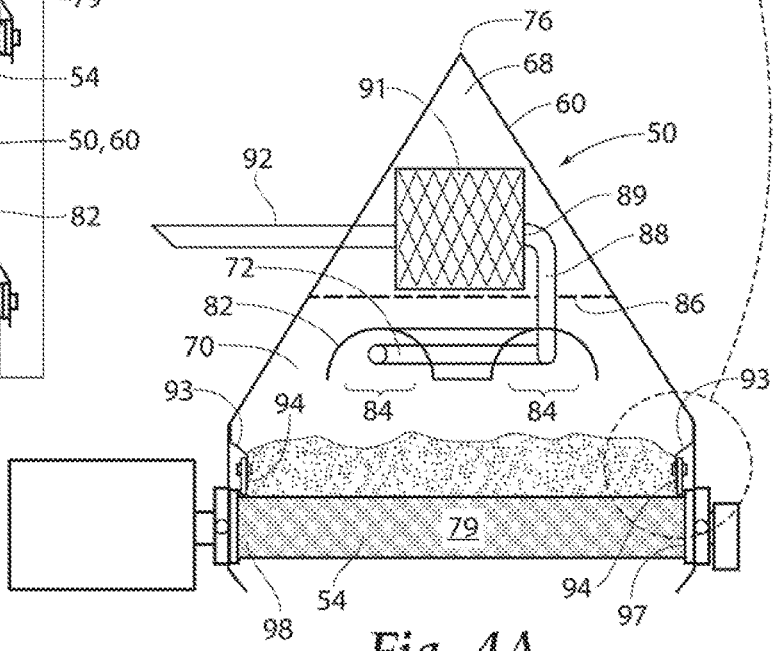
FIG. 4A is a cross-sectional end view of a drying unit of the radiant conveyor drying system.

With attention to FIGS. 4A and 4B, communication between the drying unit chamber barrier 67 and the drying unit conveyor belt 79 is described. At least one side bolster 93 extends from the drying unit chamber barrier 67 into the plenum 68 in close proximity to at least one of a conveyor first aide 97 and a conveyor second side 98. The at least one bolster 93 extends at least substantially along the drying unit chamber length 69 in close proximity to at least one of the conveyor first side 97 and the conveyor second side 98. A wear bar 94 is in adjustable communication with the bolster 93. The wear bar 94 has an adjustment mechanism 95 in order to position the wear bar 94 in close proximity to the drying unit conveyor belt 79. The adjustment mechanism 95 may comprise a bolt 163 in threaded communication with the bolster 93 and the wear bar comprises an elongated grove 164 in which the bolt may slide in order to adjust a distance between the wear bar 94 and the drying unit conveyor belt 79. At least one barrier through hole 96 is provided in the drying unit chamber barrier 67 to provide for adjustment of the wear bar 94.

Figure 5A:
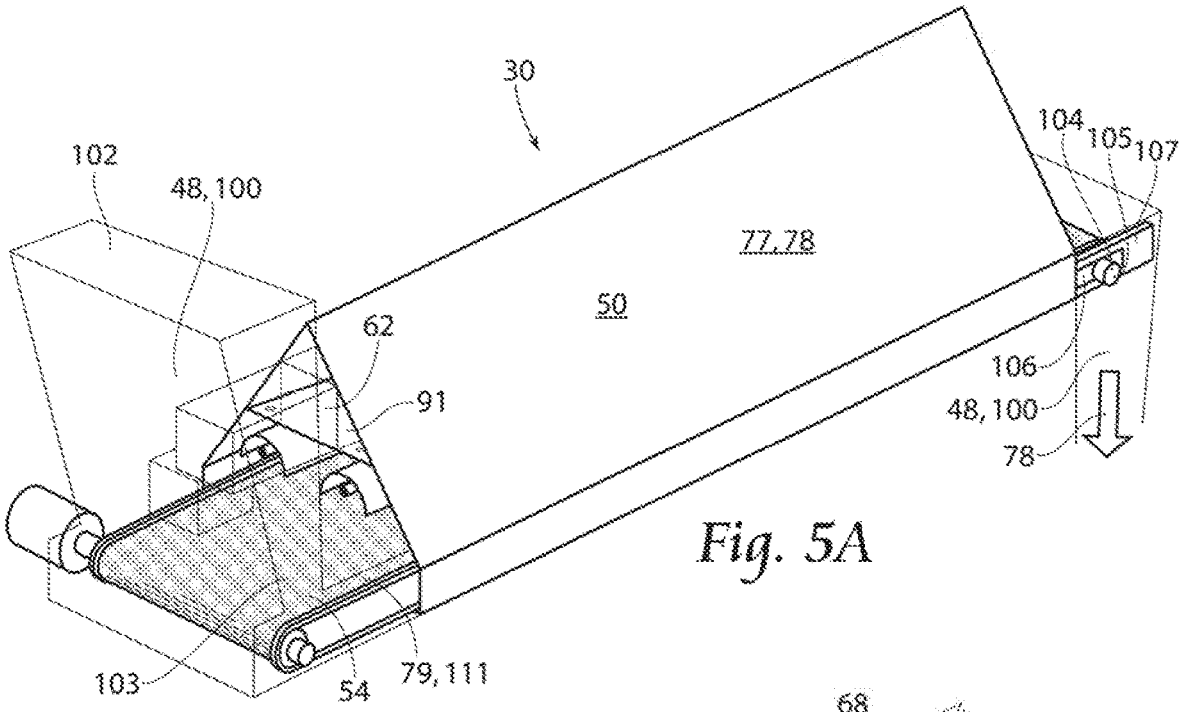
FIG. 5A is a perspective view of the drying unit comprising a first embodiment of the conveyor belt.

As illustrated in FIGS. 2 and 5A, an entry transfer chute (48, 100) is positioned along at least one of the radiant conveyor drying system first side 36 and the radiant conveyor drying system second side 38 of each drying unit 50. Where the entry transfer chute (48, 100) comprises an entry transfer chute first end 102 and an opposite entry transfer chute second end 103. The entry transfer chute first end receives product from at least one the drying unit conveyor 54 of the first drying unit 77 and the first conveyor 42. The product traverses through the entry chute (48, 100) and exits the entry chute second end 103 onto the drying unit conveyor 54 of the respective first drying unit 77 or second drying unit 78. The product travels along the drying unit conveyor 54 to the opposite end of the drying unit 50, whether that is the first side 36 or the second side 38. An entry chute of the subsequent drying unit, the second drying unit 78, is in mechanical communication with at least one of the conveyor 54 and the drying unit 50 as a whole, wherein the attached transfer chute provides for transfer of the product 34 to the second drying unit 78. Wherein the product 34 is transferred from the first drying unit 77 to the second drying unit 78, below the first drying unit. As further illustrated in FIG. 9, there may be multiple first drying units 77 and second drying units 78 in a radiant conveyor drying system 6. Further, a respective drying unit 50 may be represented as a first drying unit 77 and a second drying unit 78. As a second drying unit 78, product 34 may be transferred to it from a prior drying unit 50. As a first drying unit, product 34 is transferred from the drying unit (50, 77) to a subsequent second drying unit 78.

As illustrated in FIG. 5A, a conveyor belt tensioner 104 is provided for adjusting the tension of the drying unit conveyor belt 79. The conveyor belt tensioner 104 comprises a tensioner extension 105 in slidable communication within a through slot 106 provided in the drying unit conveyor 54, preferably at least one side frame 107 of the drying unit conveyor 54. The tensioner extension 105 is preferably attached to an axle (not illustrated in the figures) of the drying unit conveyor 54 and extends through the through slot 106. The tensioner extension 105 slides within through slot 106 to provide for adjusting the tension of the drying unit conveyor belt 79. The tensioner extension 106 may be tightened to set the tension of the drying unit conveyor belt 79.

Figure 5B:
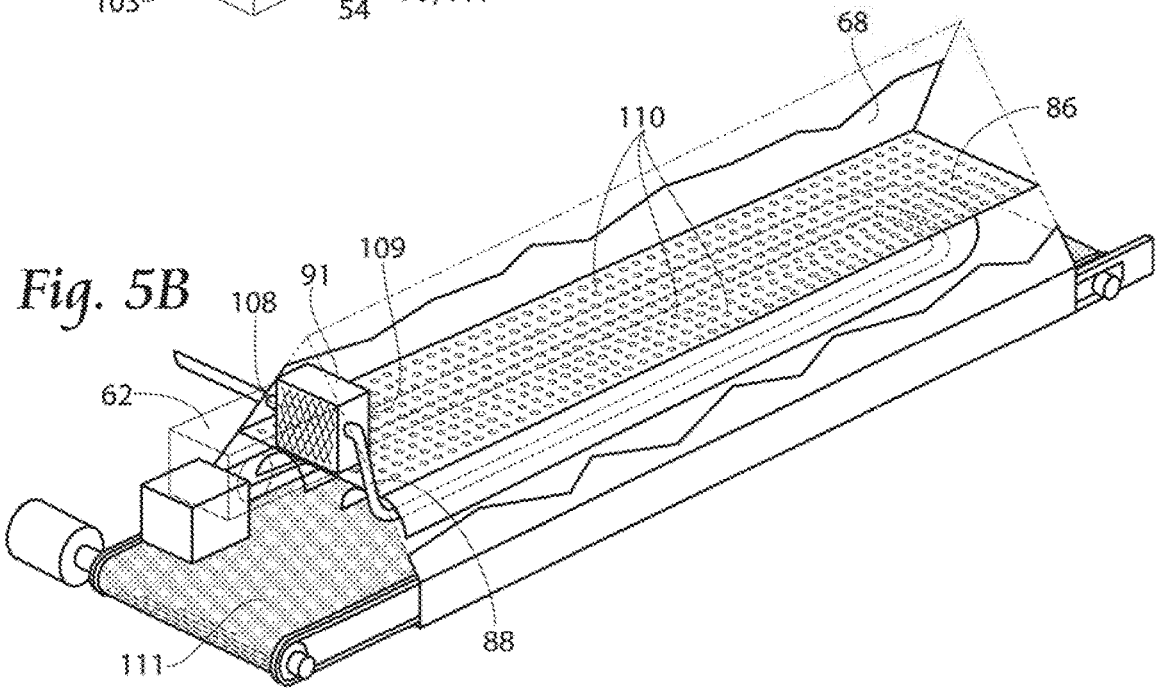
FIG. 5B is a partial sectional perspective view of the drying unit comprising the first embodiment of the conveyor belt.

As further illustrated in FIGS. 2 and 5B, the blower fan 62 and the heat exchanger 91 are in close communication to one another. Wherein air from the blower fan 62 is blow towards and through a heat exchanger first surface 108. The air passes through the heat exchanger 91 and beyond a heat exchange second surface 109 and into the plenum 68. Radiant heat 154 (reference FIGS. 9 and 10) is transferred into the heat exchanger 91 through the heating element extension 88. The air passing from the blower fan 62 and into the heat exchanger 91 is heated due to the radiant heat 154 (reference FIGS. 9 and 10) from the heating element extension 88. The heated air passes through the heat exchanger second surface 109 and into the plenum 68. The plenum floor 86 comprises at least one floor through hole 110. The air transferred into the plenum 68 through convection exits the plenum 68 through the at least one floor through hole 110.

Figure 6:
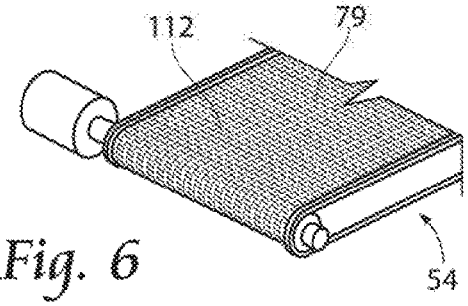
FIG. 6 is a partial view of a conveyor of the drying unit comprising a second embodiment of the conveyor belt.

As illustrated in FIGS. 4B, 5B and 6, two embodiments of the drying unit conveyor belt 79 may be provided. As illustrated in FIG. 5B, a perforated conveyor belt 111 is provided. As illustrated in FIG. 4B, the perforated conveyor belt 111 comprises at least one perforated belt through hole 114. The perforated conveyor belt 111 allows for by-product to fall through the perforated belt through hole 114 of the conveyor belt (79, 111) and down the drying unit chamber barrier 67 so that the by-product is removed from the radiant conveyor drying system 6. As illustrated in FIG. 6, a chain mesh conveyor belt 112 is preferably provided. The chain mesh conveyor belt 112 allows for by-product to fall through the conveyor belt (79, 112) and down the drying unit chamber barrier 67 so that the by-product is removed from the radiant conveyor drying system 6.

Figure 7:
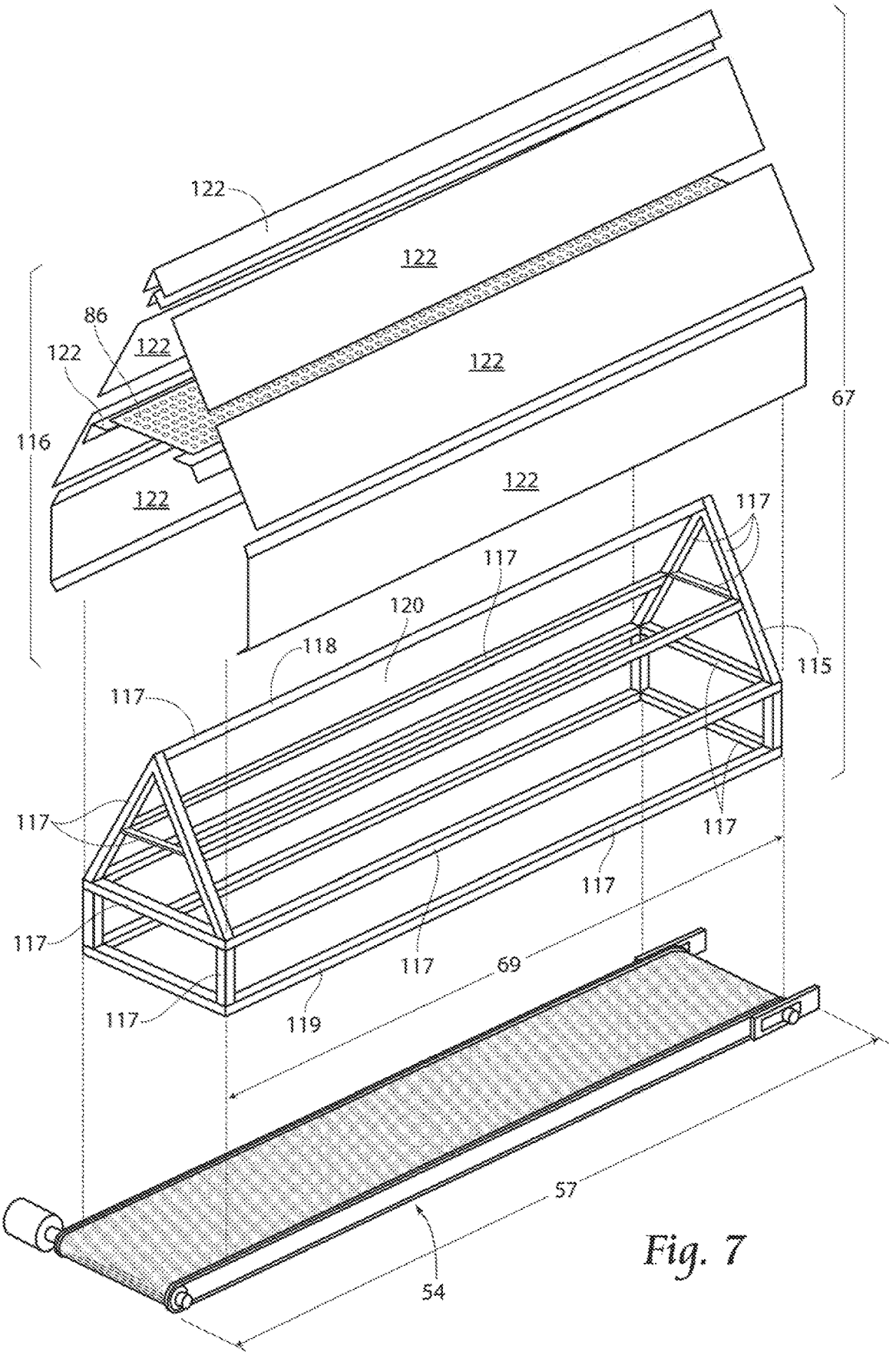
FIG. 7 is an exploded view of the drying unit chamber barrier of the radiant conveyor drying system in communication with the conveyor.

With attention to FIG. 7, the drying unit chamber barrier 67 is further described. The drying unit chamber barrier 67 comprises a barrier frame 115 and a barrier shell 116. The barrier frame 115 comprises frame segments 117 fixed to one another to create the barrier frame 115. The barrier frame 115 preferably comprises a triangular prism 118, made of the frame segments 117, fixed to a rectangular prism 119, made of the frame segments 117. At least one of the triangular prism 118 and the rectangular prism 119 extends at least substantially the drying unit chamber length 69. The barrier frame 115 defines a frame cavity 120. Wherein the frame cavity 120 comprises the plenum 68 and the heating chamber 70. The barrier frame 115 of each respective drying unit 50 extends substantially parallel to the drying unit conveyor length 57, for the respective drying unit 50. The barrier shell 116 comprises at least one barrier sheet 122. The barrier sheet 122 is removably attached to the barrier frame 155 to further define the frame cavity, and further define the plenum 68 and the heating chamber 70. The barrier sheet 122 extends along drying unit chamber length 69. The barrier sheet 122 is positioned to allow for advancement of product 34 along the drying unit conveyor 54. It is observed the plenum floor 86 is preferably supported by the at least one barrier sheet 122. Alternatively, the plenum floor 122 may be supported by the barrier frame 115.

Alternatively, the drying unit chamber barrier 67 may comprise at least one barrier sheet 122 as previously described without the barrier frame 115.

As illustrated FIG. 2, the exit assembly 16 is attached to one of the drying units 50 of the radiant conveyor drying system 6 to provide for removal of product 34 from the radiant conveyor drying system 6 following progression through the radiant conveyor drying system 6.

Figure 8A:
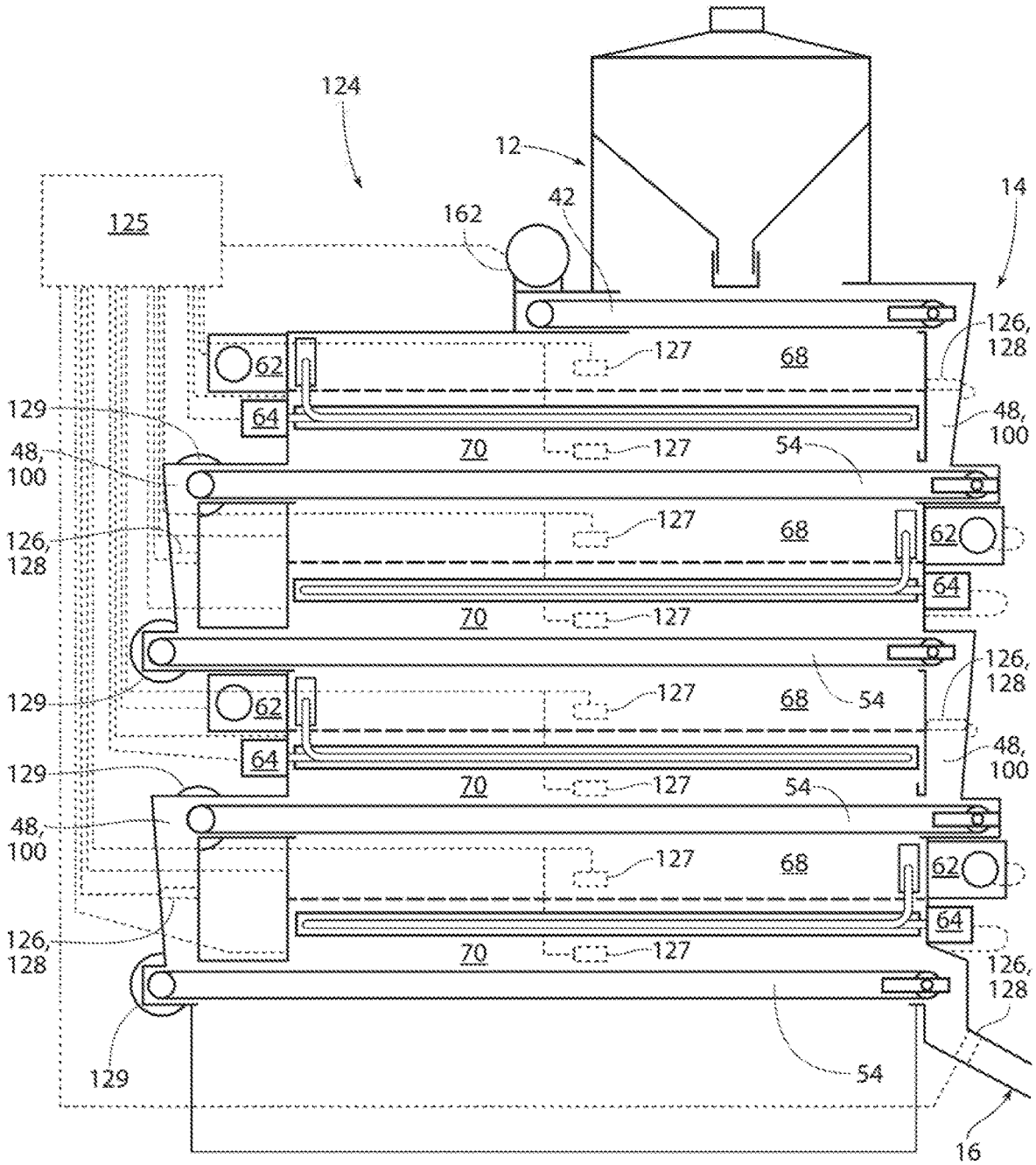
FIG. 8A a cross-sectional side view of a first embodiment of the radiant conveyor drying system illustrating an electronic control system for temperature control.
Figure 8B:
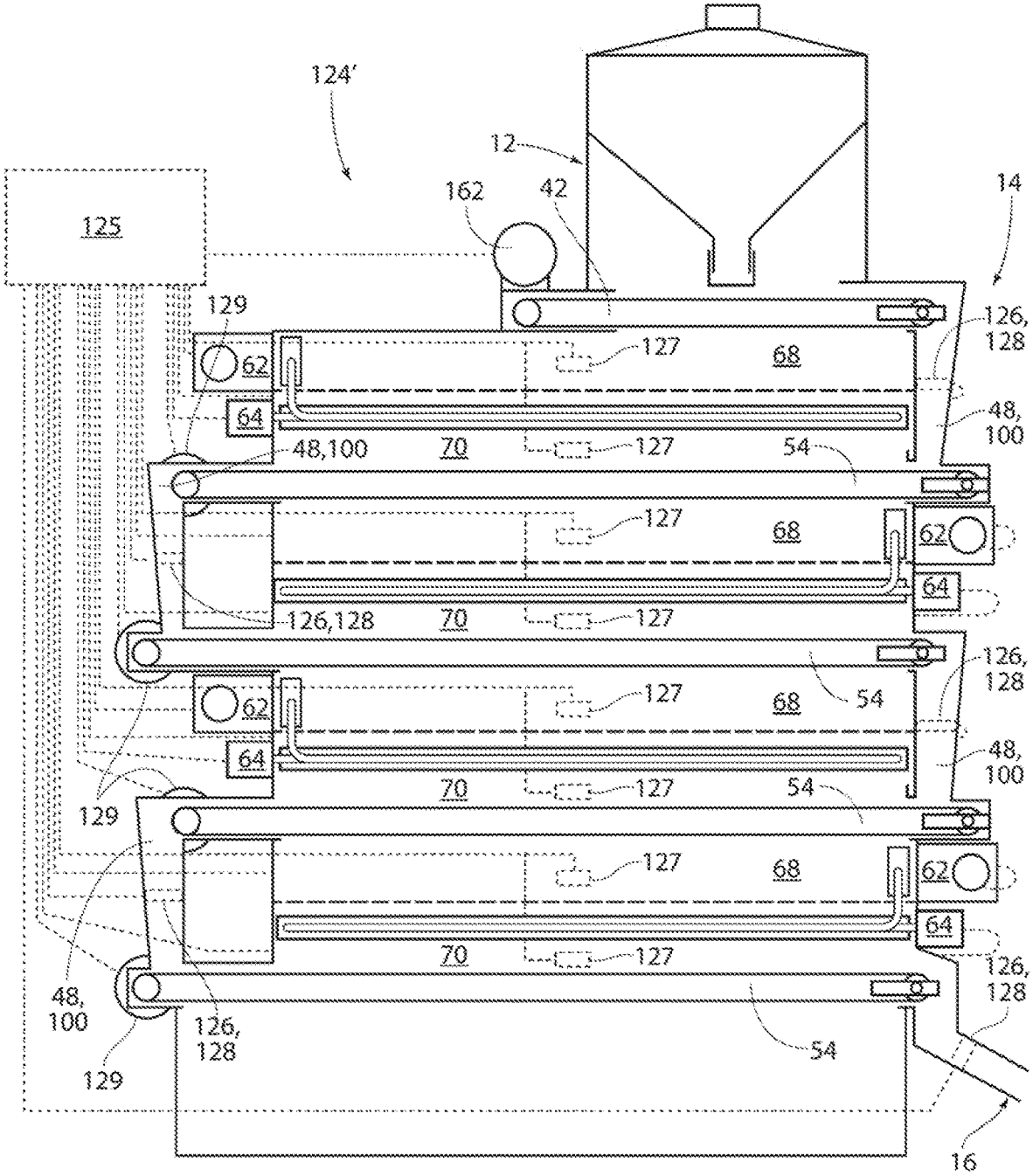
FIG. 8B a cross-sectional side view of a second embodiment of the radiant conveyor drying system illustrating the electronic control system for temperature control and conveyor speed control.

As illustrated in FIGS. 8A and 8B, a first embodiment of the radiant conveyor drying system 124 is described, FIG. 8A, and a second embodiment of the radiant conveyor drying system 124', FIG. 8B, is described. The first embodiment of the radiant conveyor drying system 124 incorporates at least one aspect of the radiant conveyor drying system 6 as previously described. The second embodiment of the radiant conveyor drying system 124' incorporates at least one aspect of the radiant conveyor drying system 6 as previously described.

As illustrated in FIGS. 8A and 8B, the first embodiment of the radiant conveyor drying system 124 and the second embodiment of the radiant conveyor drying system 124' are respectively described. In both the first embodiment of the radiant conveyor drying system 124 and the second embodiment of the radiant conveyor drying system 124', the drying system (124, 124') comprises a programmable logic controller (PLC) 125. The PLC 125 is in electric communication with at least one of the first conveyor motor 162 and each of the conveyor motors 129 providing movement to each of the respective conveyors (42, 54). The PLC 125 is in electrical communication with the blower fan 62 of each drying unit 50, controlling power to the blower fan 62. Further, the PLC 125 is in electrical communication with the burning unit 64 of each drying unit 50, providing power to the burning unit 64.

As illustrated in FIGS. 5A and 8B, the first embodiment of the radiant conveyor drying system 124 and the second embodiment of the radiant conveyor drying system 124' comprise at least one moisture sensor 126 positioned in at least one entry transfer chute (48, 100) of the radiant conveyor drying system 6. Alternatively, the radiant conveyor drying system 124 comprises at least one moisture sensor 126 positioned in close proximity to at least one entry transfer chute (48, 100) of the radiant conveyor drying system 6. Preferably, the radiant conveyor drying system (124, 124') comprises at least one moisture sensor 126 is at least one of positioned in each entry transfer chute (48, 100) of the radiant conveyor drying system 6, and positioned in close proximity to each entry transfer chute (48, 100) of the radiant conveyor drying system 6. The at least one moisture sensor 126 is electrically coupled to the PLC 125. The moisture sensor 126 takes at least one reading of the moisture of the product 34 transferring through the respective entry transfer chute (48, 100) at a predetermined rate. The moisture sensor 126 transmits the moisture readings of the product 34 transferring through the respective entry transfer chute (48, 100) to the PLC 125. The moisture sensor 126 may incorporate a first temperature sensor 128. The first temperature sensor 128 takes at least one reading of the temperature of the product 34 transferring through the respective entry transfer chute (48, 100) at a predetermined rate. The first temperature sensor 128 transmits the temperature readings of the product 34 transferring through the respective entry transfer chute (48, 100) to the PLC 125.

The first embodiment of the radiant conveyor drying system 124 and the second embodiment of the radiant conveyor drying system 124' further incorporate at least one second temperature sensor 127 along the drying unit assembly length 56 positioned in at least one plenum 68 of the radiant conveyor drying system 6. Alternatively, the radiant conveyor drying system (124, 124') comprises at least one second temperature sensor 127 positioned in close proximity to at least one plenum 68 of the radiant conveyor drying system 6. Preferably, the radiant conveyor drying system (124, 124') comprises at least one second temperature sensor 127 is at least one of positioned in each plenum 68 of the radiant conveyor drying system 6, and positioned in close proximity to each plenum 68 of the radiant conveyor drying system 6 in each heating chamber 70. The at least one second temperature sensor 127 is electrically coupled to the PLC 125. The second temperature sensor 127 taken at least one reading of the temperature of the convective air, heated convective air 158 (reference FIG. 9), within the plenum 68 at a predetermined rate. Alternatively, the second temperature sensor 127 may incorporate components to take at least one reading of a product surface temperature 167 of the product 34 on the respective drying unit conveyor 54 (reference FIG. 9). Alternatively, the second temperature sensor 127 may take both temperature readings of the convective air, heated convective air 158, within the heating chamber 70 and temperature readings of the product surface temperature 167 of the product 34 as previously described. The second temperature sensor 127 transmits the temperature readings of at least one of the heated convective air 153 and the product surface temperature 167 of the product 34 to the PLC 125.

Further, the first embodiment of the radiant conveyor drying system 124 and the second embodiment of the radiant conveyor drying system 124' comprise at least one moisture sensor 126 positioned in the exit assembly 16 of the radiant conveyor drying system 6. Alternatively, the radiant conveyor drying system (124, 124') comprises at least one moisture sensor 126 positioned in close proximity to the exit assembly 16 of the radiant conveyor drying system 6. The at least one moisture sensor 126 is electrically coupled to the PLC 125. The moisture sensor 126 takes at least one reading of the moisture of the product 34 transferring through the respective entry transfer chute (48, 100) at a predetermined rate. The moisture sensor 126 transmits the moisture readings of the product 34 transferring through the exit assembly 16 to the PLC 125. The moisture sensor 126 may incorporate a first temperature sensor 128. The first temperature sensor 128 takes at least one reading of the temperature of the product 34 transferring through the exit assembly 16 at a predetermined rate. The first temperature sensor 128 transmits the temperature readings of the product 34 transferring through the exit assembly 16 to the PLC 125.

As illustrated in FIG. 8A, the first embodiment of the radiant conveyor drying system 124 further comprises the following. The PLC 123 retrieves the measurement data from each of the at least one moisture sensor 126, the at least one second temperature sensor 127, and where applicable the at least one first temperature sensor 128. The PLC 125 computes the amount heat required to be produced by each burning unit 64 within the radiant conveyor drying system 6 in order to attain an optimum moisture reading from, the moisture sensor 126 at or in close proximity to the exit assembly 16 for the product 34. The process of measurement, calculation, and adjustment of heat produced by each burning unit 64 continues at a predetermined rate. It is observed the blower fans, conveyor motors 129 and first conveyor motor 162 are preferably maintained at a constant speed.

As illustrated in FIG. 8B, the second embodiment of the radiant conveyor drying system 124' further comprises the following. The PLC 125 retrieves the measurement data from each of the at least one moisture sensor 126, the at least one second temperature sensor 127, and where applicable the at least one first temperature sensor 128. The PLC 125 computes the amount heat required to be produced by each burning unit 64 within the radiant conveyor drying system 6 and an independent preferred speed of each conveyor motor 129 and the first conveyor motor 162 in order to attain an optimum moisture reading from the moisture sensor 126 at or in close proximity to the exit assembly 16 for the product 34. The process of measurement, calculation, and adjustment of heat produced by each burning unit 64 and speed of each conveyor motor 129 and the first conveyor motor 162 continue at independent predetermined rates. It is observed the blower fans are preferably maintained at a constant speed.

Figure 9:
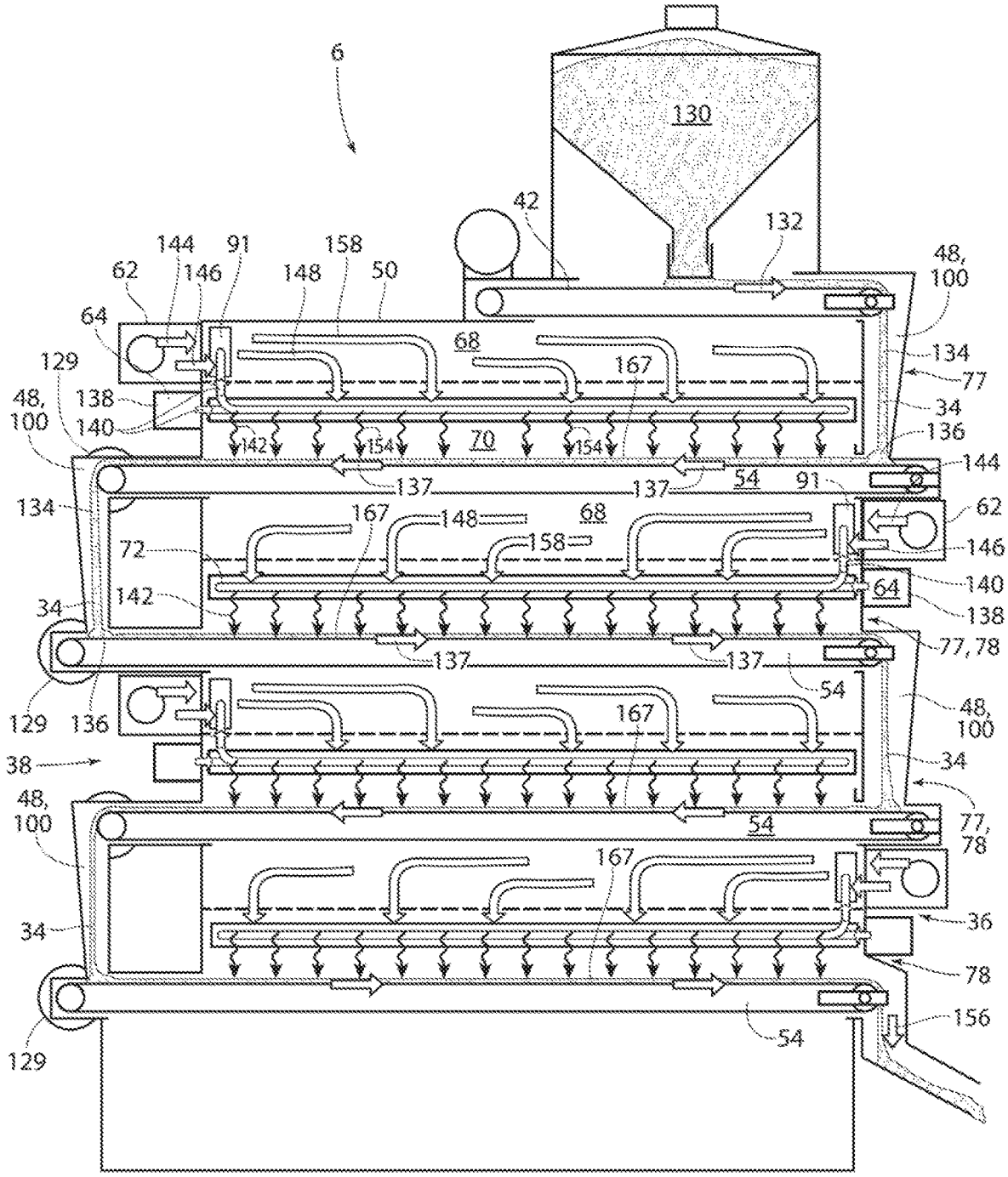
FIG. 9 is a method of operating the radiant conveyor drying system.
Figure 10:
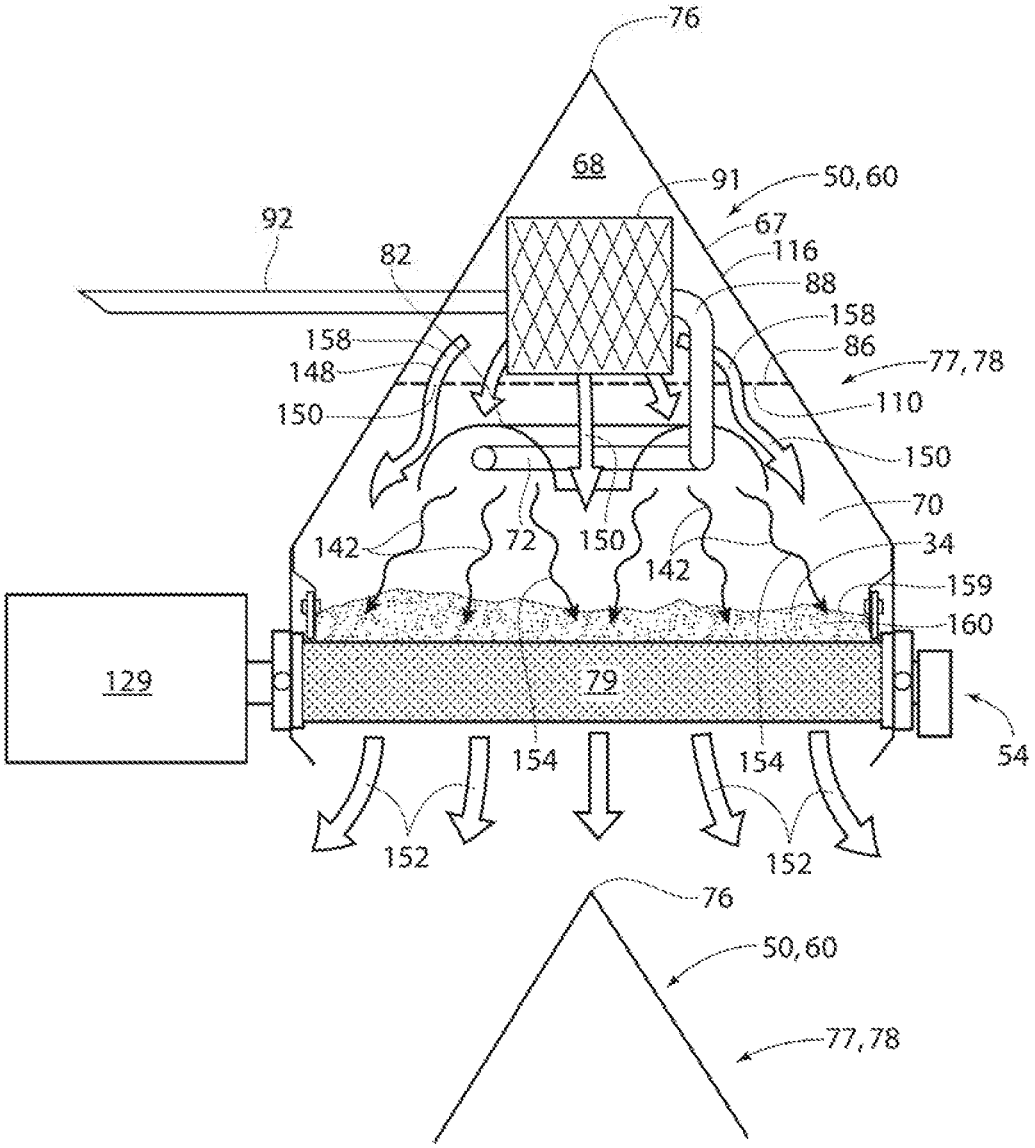
FIG. 10 is a cross-sectional end view of the drying unit of the radiant conveyor drying system illustrating the method of operating the radiant conveyor drying system.

With attention to FIGS. 9 and 10, a method of operating the radiant conveyor drying system 6 is shown. As illustrated in FIG. 9, product 34 is stored in the hopper, 130. The product 34 is transferred onto the first conveyor 42, which moves the product towards the radiant conveyor drying system first side 36, 132. The product 34 travels through the entry transfer chute (48, 100), 134. The product 34 is placed on the drying unit conveyor 54, 136. The product 34 travels along the drying unit conveyer 54, 137. The burning unit 64 produces radiant heat 154, 138. The radiant heat 154 travels through the heating element 72, 140. Radiant heat 154 is eminent from the heating element 72 towards the product 34 traveling along the drying unit conveyor 54, 142. The blower fan 62 produces convective air, 144. The convective air transfers into the drying unit 50 and through the heat exchange 91, 146. The heated convective air 158 travels into the plenum 68. As illustrated in FIG. 10, the heated convective air 158 further travels through the plenum 68, 148. The heated convective air 158 is directed through the at least one floor through hole 110 of the plenum floor 86, 150. By-product (not illustrated in the figures) falls through the drying unit conveyor belt 79, to be removed from the process, 152. It is understood that steps 134 to 152 are repeated for each drying unit 50 comprising the radiant conveyor drying system 6. Upon traveling along the last drying unit conveyor 54 of the last second drying unit 78, the product exits the radiant conveyor drying system 6 through the exit assembly 16, 156.

As illustrated in FIG. 10, it is understood that the radiant heat 154 initially contact a a top product layer 159. The radiant heat 154 evaporates moisture on the surface of the individual parts of the top product layer 159. The heated convective air 153 advances the radiant heat 154 towards the remaining product 160. Wherein the radiant heat 154 evaporates the moisture on the surface of the individual parts of the remaining product 160. This process of radiant evaporation and convection continues through the radiant conveyor drying system 6.

At least one element of the first embodiment of the radiant conveyor drying system 124 may be combined with at least one element of the second embodiment of the radiant conveyor drying system 124'.

At least one element of the perforated conveyor belt 111 may be combined with at least one element of the chain mesh conveyor belt 112.

The invention provides for an intended benefit of a radiant conveyor drying system comprising a conveyor system.

The invention provides for an intended benefit of a radiant conveyor drying system comprising a layered conveyor system.

The invention provides for an intended benefit of a radiant conveyor drying system comprising at least one radiant element above the product.

The invention provides for an intended benefit, of a radiant conveyor drying system comprising a convection directing air through the at least one radiant element and towards the product.

The invention provides for an intended benefit of a radiant conveyor drying system comprising an element for continuous removal of byproduct.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the disclosure.

I claim:

1. A radiant conveyor drying system for dying plant products, comprising:

a drying assembly, having a length;

said drying assembly having at least two drying units layered above one another; and substantially parallel to one another along said length;

each said drying unit comprising a conveyor for advancing said plant products along said length and a chamber positioned above said conveyor;

said chamber further defined by a barrier having at least a substantially triangular cross-section with an apex, opposite said conveyor, and sides extending from said apex; and said drying unit providing for at least one of a radiant heat element and a convective air source within each said chamber.

2. The radiant conveyor drying system of claim 1, further comprising said drying assembly having four drying units layered above one another and substantially parallel to one another along said length.

3. The radiant conveyor drying system of claim 1, further comprising said chamber having a plenum positioned over a heating chamber, with said heating chamber positioned over said conveyor, said plenum communication with a fan, wherein a connective air is promoted into said plenum.

4. The radiant conveyor drying system of claim 3, further comprising said heating chamber is in communication with a burning unit, wherein in a radiant heat is provided through said heating chamber.

5. The radiant conveyor drying system of claim 3, further comprising said plenum having a floor with at least one through hole for promotion of said convective air into said heating chamber.

6. The radiant conveyor drying system of claim 1, further comprising said conveyor of a first drying unit is positioned over, and in close proximity to, said apex of a second drying unit.

7. The radiant conveyor drying system of claim 6, further comprising sides of a second drying unit are surfaces for a by-product removal from said first drying unit.

8. The radiant conveyor drying system of claim 6, further comprising at least one chute for said plant products transfer from said first drying unit to said second drying unit.

9. The radiant conveyor drying system of claim 1, further comprising at least one side having an adjustment bar, opposite said apex, to provide for a close proximity between said side and said conveyor.

10. The radiant conveyor drying system of claim 1, wherein said barrier is defined by at least one of a shell and a frame.

11. The radiant conveyor drying system of claim 10, wherein said shell comprising more than one sheet.

12. The radiant conveyor drying system of claim 1, further comprising an input for addition of said plant products to said system.

13. The radiant conveyor drying system of claim 12, further comprising said input having a cut off plate for manual control of a flow of said plant products into said system.

14. The radiant conveyor drying system of claim 3, further comprising at least one of at least one moisture sensor and at least one temperature sensor to acquire measurement data, said measurement data comprising at least one of temperature of said plant products, humidity of said plant products, and temperature of said convective air in at least one drying unit.

15. The radiant conveyor drying system of claim 12, wherein said system provides an adjustment to at least one of a temperature within at least one said chamber and a rate of travel of at least one said conveyor based upon said measurement data.

16. A method of operating a radiant conveyor drying system for drying of plant products, comprising:

positioning said plant products onto a conveyor of a first drying unit;

advancing said conveyor;

producing radiant heat in said drying unit with at least one of a burning unit and a heating element;

directing said radiant heat in a downward direction onto said plant products positioned on said conveyor within said first drying unit;

producing convective air in said drying unit with at least one of a fan and a heat exchanger;

advancing said convective air in a downward direction about said plant products positioned on said conveyor;

forcing radiant heat through said plant products with said convective air; and removing a byproduct of said plant products from said system through:

filtering said byproduct through said conveyor and onto a triangular cross-sectioned barrier; and advancing said byproduct along said barrier and away from said system.

17. A method of operating a radiant conveyor drying system of claim 16, further comprising transferring said plant products to a conveyor of said subsequent drying unit.

18. A method of operating a radiant conveyor drying system of claim 17, further comprising in said subsequent drying unit, repeating said steps of: positioning of said plant products, advancing of said conveyor, producing radiant heat, directing radiant heat, producing convective air, promotion of movement of convective air, encouraging movement of radiant heat through said plant products with said convective air, and removing said byproduct.

19. A method of operating a radiant conveyor drying system of claim 16, further comprising promoting movement of said convective air in a downward direction through at least one hole in a floor of said plenum, and about said plant products.

* * * * *